US008297539B2

(12) United States Patent
Ko

(10) Patent No.: US 8,297,539 B2
(45) Date of Patent: Oct. 30, 2012

(54) LEAKPROOF PERFUME BOTTLE SPRAY HEAD ASSEMBLY WITH POSITIONING SOUND INDICATION

(76) Inventor: Chuan-Wei Ko, Chung-Li (TW)

( * ) Notice: Subject to any disclaimer, the term of this patent is extended or adjusted under 35 U.S.C. 154(b) by 266 days.

(21) Appl. No.: 12/876,107

(22) Filed: Sep. 4, 2010

(65) Prior Publication Data

US 2012/0056009 A1 Mar. 8, 2012

(51) Int. Cl.
*B05B 1/30* (2006.01)

(52) U.S. Cl. ..... 239/581.1; 239/333

(58) Field of Classification Search ..... 239/581.1, 239/302, 333, 359, 360, 600; 215/227, 228, 215/230, 305, 341; 222/564
See application file for complete search history.

(56) References Cited

U.S. PATENT DOCUMENTS

| | | | | |
|---|---|---|---|---|
| 5,439,103 | A * | 8/1995 | Howes | 206/217 |
| 6,923,343 | B1 * | 8/2005 | Erxleben | 222/153.09 |
| 7,331,489 | B2 * | 2/2008 | Glynn et al. | 222/211 |
| 7,971,739 | B2 * | 7/2011 | Ammann | 215/257 |
| 2006/0108377 | A1 * | 5/2006 | Glynn et al. | 222/205 |
| 2008/0149638 | A1 * | 6/2008 | Van Hees et al. | 220/254.8 |
| 2010/0294739 | A1 * | 11/2010 | Morris et al. | 215/227 |

* cited by examiner

*Primary Examiner* — Davis Hwu

(57) ABSTRACT

A leak-proof perfume bottle spray head assembly includes a bottle cap having a tubular holder block and a rotating shaft rotatably mounted in said tubular holder block, a positioning block having a base coupled to the rotating shaft and a sound-making unit extending along the periphery of the base, the sound-making unit having a positioning face and a retaining rib, and a spray head coupled to the rotating shaft and having a deformable rail which will be rubbed against the sound-making unit to make click sound during rotation of the rotating shaft with the spray head from the open position to the close position and a retaining portion for engagement with the retaining rib when the rotating shaft is rotated to the close position.

4 Claims, 12 Drawing Sheets

LEAKPROOF PERFUME BOTTLE SPRAY HEAD ASSEMBLY WITH POSITIONING SOUND INDICATION

BACKGROUND OF THE INVENTION

1. Field of the Invention

The present invention relates to a perfume bottle and more particularly, to a leak-proof perfume bottle spray head assembly with positioning sound indication that provides a sound indication when the user closes spray head, avoiding over-tightened damage.

2. Description of the Related Art

Conventional spray type perfume bottles commonly have a spray head operable to spray perform. However, the spray head may be pressed to discharge perfume accidentally. To eliminate this problem, the invention created a leak-proof perfume spray head structure, which is patented under U.S. Pat. No. 7,559,441B2.

Referring to FIGS. 1-2, according to this prior art design, when rotating the spray head 6, the bump 81 of the rotating shaft 8 is moved to the hole 71 of the member 7 to stop the passage of the hole 71. On the contrary, when rotating the spray head 6 in the reversed direction to move the bump 81 of the rotating shaft 8 away from the hole 71 of the member 7, the hole 71 is opened, allowing the liquid perfume to be forced through the hole 71 and the axial hole 82 of the rotating shaft 8 into the spray head 6 and then driven out of the spray head 6 for application. Further, the rotating shaft 8 has a sliding groove 83 coupled to a protruding block 72 at the member 7 to confine the angle of rotation of the rotating shaft 8 to a predetermined range. However, because this design of leak-proof perfume spray head structure is small-sized structure, the rotating shaft 8 may be over-tightened, causing damage to the protruding block 72. When the protruding block 72 is damaged, the leak-proof perfume spray head structure will be unable to function normally.

SUMMARY OF THE INVENTION

The present invention has been accomplished under the circumstances in view. It is one object of the present invention to provide a leak-proof perfume bottle spray head assembly with positioning sound indication, which produces a click sound when the spray head reaches the close position during rotation, avoiding over-tightened damage.

To achieve this and other objects of the present invention, a leak-proof perfume bottle spray head assembly with positioning sound indication comprises a bottle cap, a positioning block and a spray head. The bottle cap has a tubular holder block and a rotating shaft rotatably mounted in the tubular holder block. The positioning block comprises a base coupled to the rotating shaft and a sound-making unit extended from the base along the periphery thereof. The sound-making unit comprises a positioning face at one side thereof and a retaining rib at an opposite side thereof. The spray head is coupled to the rotating shaft, and adapted for rotating the rotating shaft between a close position and an open position. The spray head comprises a deformable rail longitudinally located on an inside wall thereof at one side and adapted for rubbing against the sound-making unit to make click sound during rotation of the rotating shaft with the spray head from the open position to the close position, and a retaining portion located on the inside wall opposite to the deformable rail for engagement with the retaining rib when the rotating shaft reaches the close position.

DETAILED DESCRIPTION OF THE PREFERRED EMBODIMENT

Figure 1:
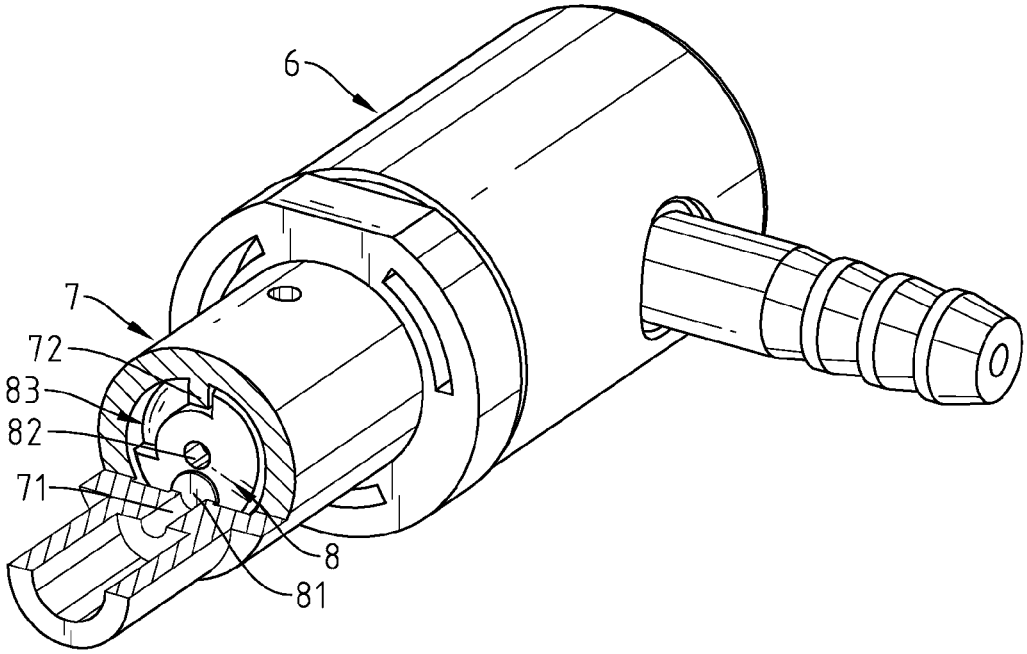
Fig. 1 Prior Art
FIG. 1 is an elevational sectional view of a leak-proof perfume spray head structure according to the prior art, illustrating the spray head in the open position.
Figure 2:
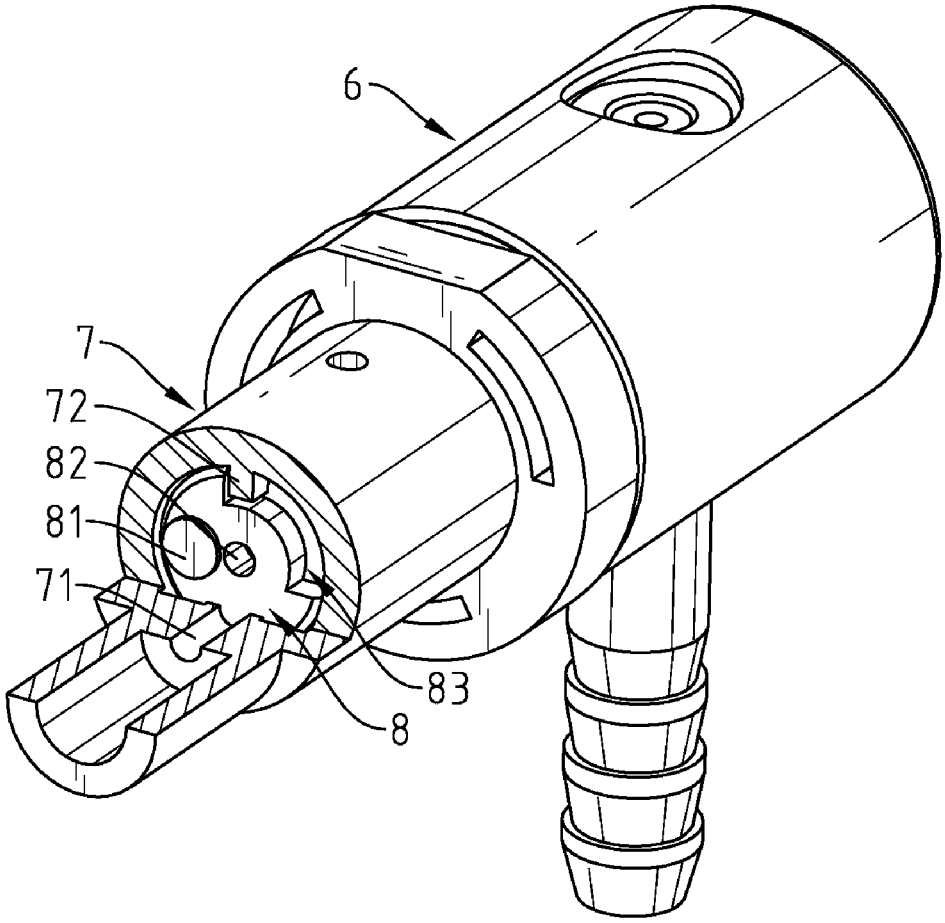
Fig. 2 Prior Art
FIG. 2 corresponds to FIG. 1, illustrating the spray head in the close position.
Figure 3:
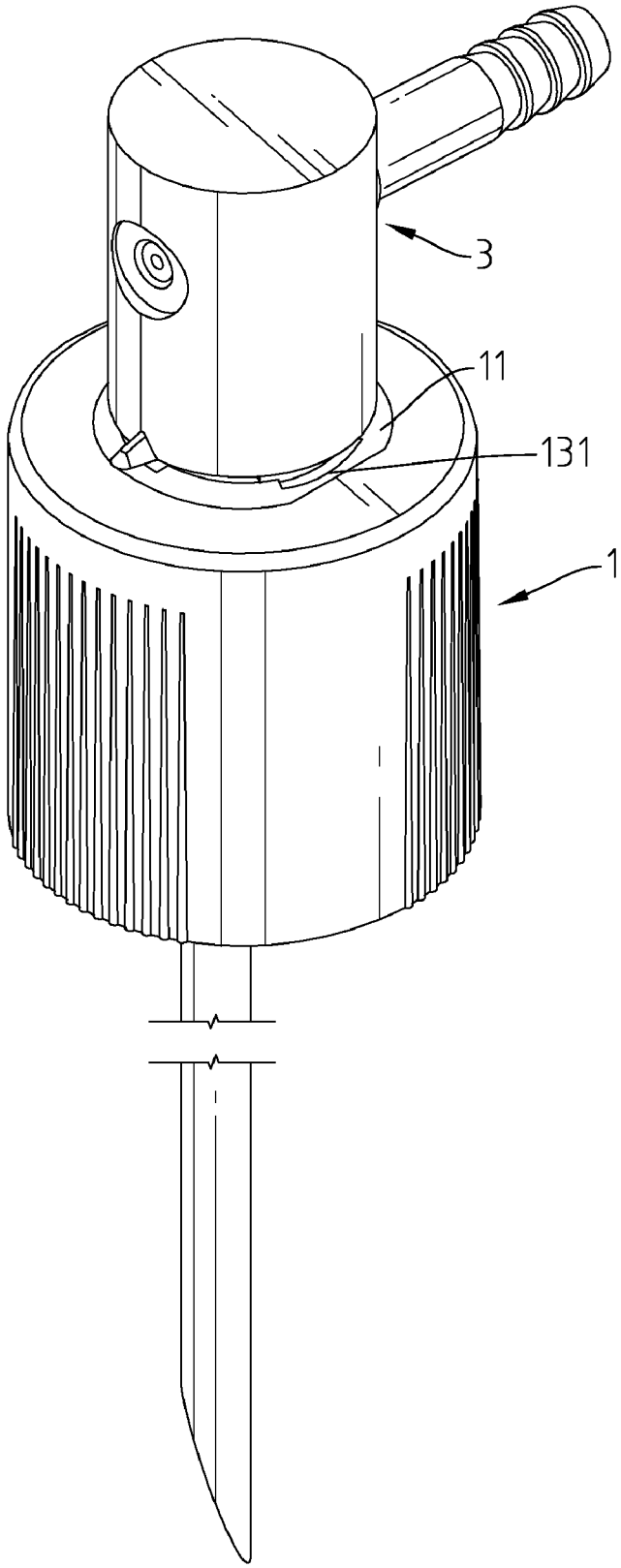
FIG. 3 is an elevational view of a leak-proof perfume bottle spray head assembly with positioning sound indication in accordance with the present invention.
Figure 4:
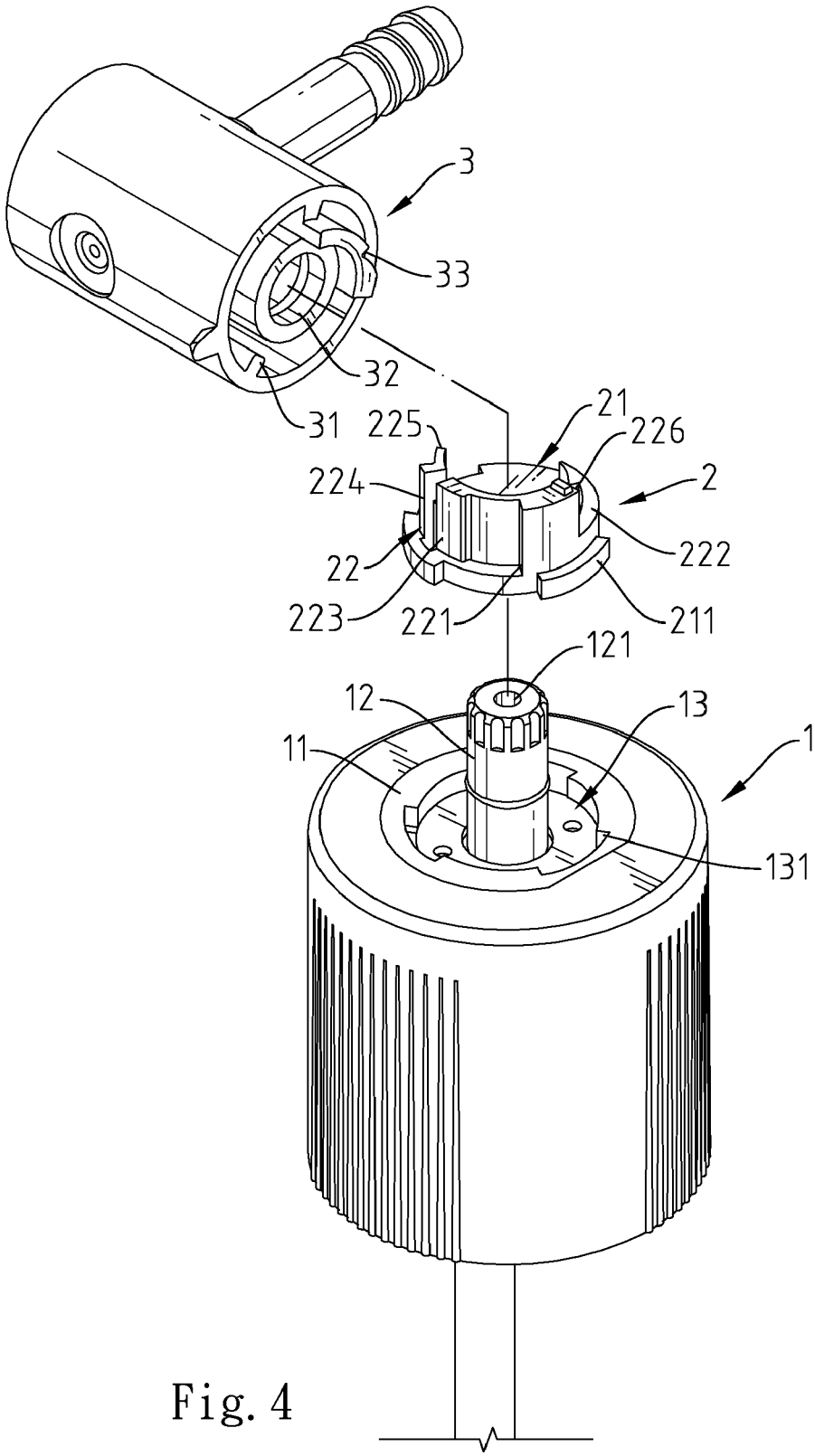
FIG. 4 is an exploded view of the leak-proof perfume bottle spray head assembly with positioning sound indication in accordance with the present invention.
Figure 5:
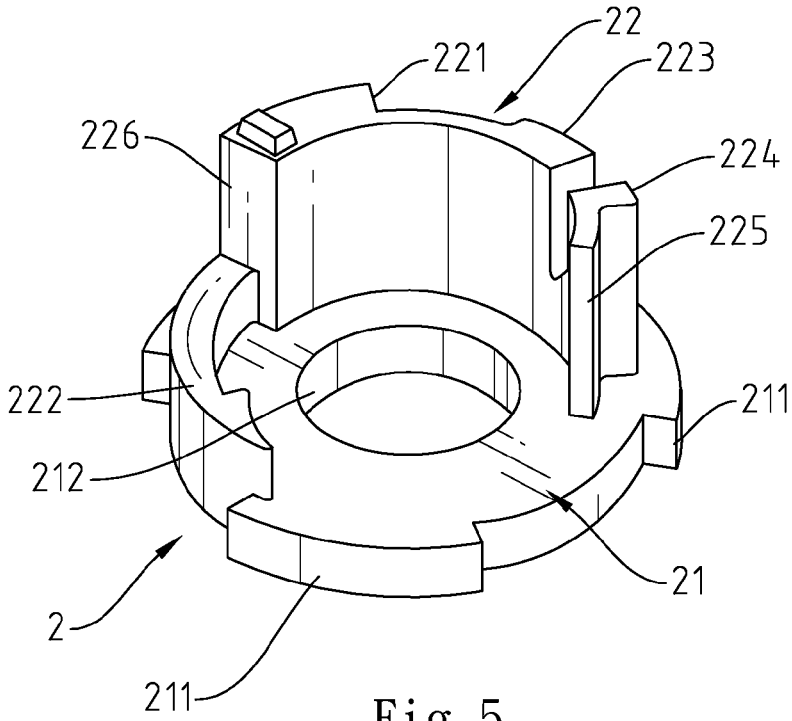
FIG. 5 is an oblique elevation of the positioning block for the leak-proof perfume bottle spray head assembly with positioning sound indication in accordance with the present invention.
Figure 6:
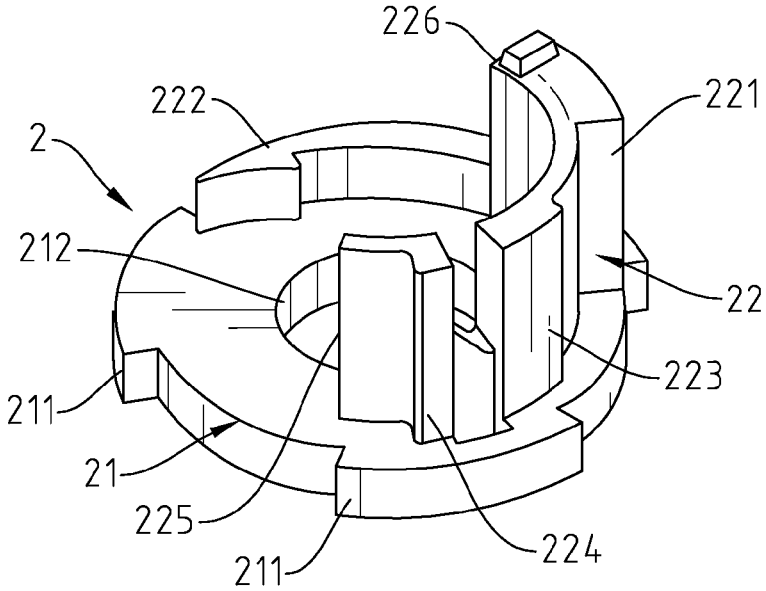
FIG. 6 corresponds to FIG. 5 when viewed from another angle.

Referring to FIGS. 3-9, a leak-proof perfume bottle spray head assembly with positioning sound indication in accordance with the present invention is shown comprising a bottle cap 1, a positioning block 2 and a spray head 3.

The bottle cap 1 has a tubular holder block 11 disposed at the center, a rotating shaft 12 rotatably mounted in the tubular holder block 11 and partially protruding over the top side of the tubular holder block 11. The rotating shaft 12 has an axial hole 121 extending through top and bottom ends thereof, a sliding groove 122 extending around the periphery of the bottom end within a predetermined angle and a bottom bump 123 located on the bottom end. The tubular holder block 11 has a protruding rod 112 inserted into the sliding groove 122 of the rotating shaft 12, a top recess 13, a plurality of locating notches 131 equiangularly spaced around the top recess 13, a bottom inlet 111 but through the bottom wall thereof. Further, the rotating shaft 12 is rotatably inserted through the top recess 13 with the bottom bump 123 stopped against the bottom wall of the tubular holder block 11.

The positioning block 2 comprises a base 21, and a sound-making unit 22. The base 21 has a through hole 212 cut through the base 21 and coupled to the rotating shaft 12, and a plurality of ribs 211 equiangularly spaced around the periphery of the base 21 corresponding to the locating notches 131 of the tubular holder block 11 of the bottle cap 1. The sound-making unit 22 extends upwardly from the top wall of the base 21 near the border area thereof, having a positioning face 221, a first stop face 225 and a second stop face 226 disposed at two opposite lateral sides relative to the positioning face 221, a first protruding portion 223 and a second protruding portion 224 disposed between positioning face 221 and the second stop face 226 and a retaining rib 222 extended from the to the first stop face 225 in direction away from the positioning face 221, the first protruding portion 223 and the second protruding portion 224.

The spray head 3 comprises an coupling tube 32 axially suspending on the inside and coupled to the rotating shaft 12, a deformable rail 31 longitudinally located on the inside wall thereof, and a retaining portion 33 disposed at one side relative to the axial center coupling hole 32 for engagement with the retaining rib 222 of the sound-making unit 22 of the positioning block 2.

During installation, insert the rotating shaft 12 of the bottle cap 1 through the through hole 212 of the base 21 of the positioning block 2 to have the positioning block 2 be positioned in the top recess 13 of the tubular holder block 11 of the bottle cap 1 and the ribs 211 of the base 21 of the positioning block 2 be respectively engaged into the locating notches 131 of the tubular holder block 11 of the bottle cap 1, and then couple the coupling tube 32 of the spray head 3 comprises to the rotating shaft 12 of the bottle cap 1, and then operate the pray head 3 to rotate the rotating shaft 12 to the position where the deformable rail 31 of the spray head 3 is stopped against the positioning face 221 of the sound-making unit 22 of the positioning block 2 and the retaining portion 33 of the spray head 3 is stopped against the first stop face 225 of the sound-making unit 22 of the positioning block 2.

Figure 7:
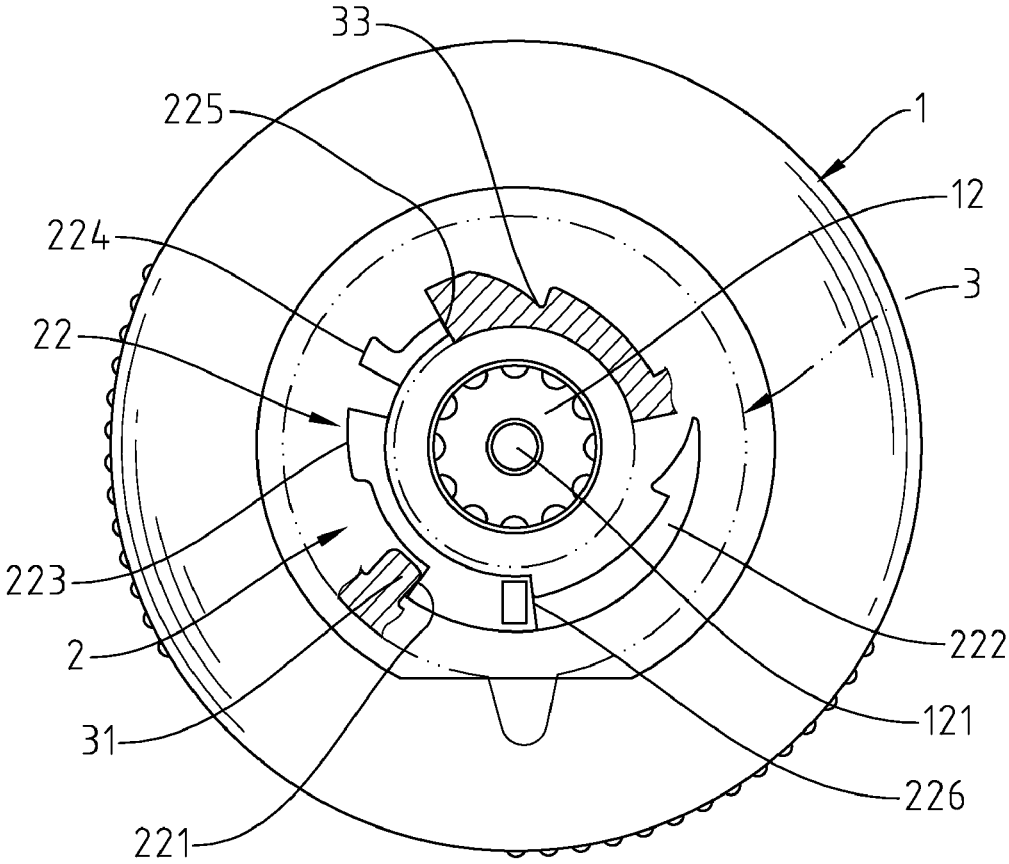
FIG. 7 is a sectional bottom view of the leak-proof perfume bottle spray head assembly with positioning sound indication in accordance with the present invention.
Figure 8:
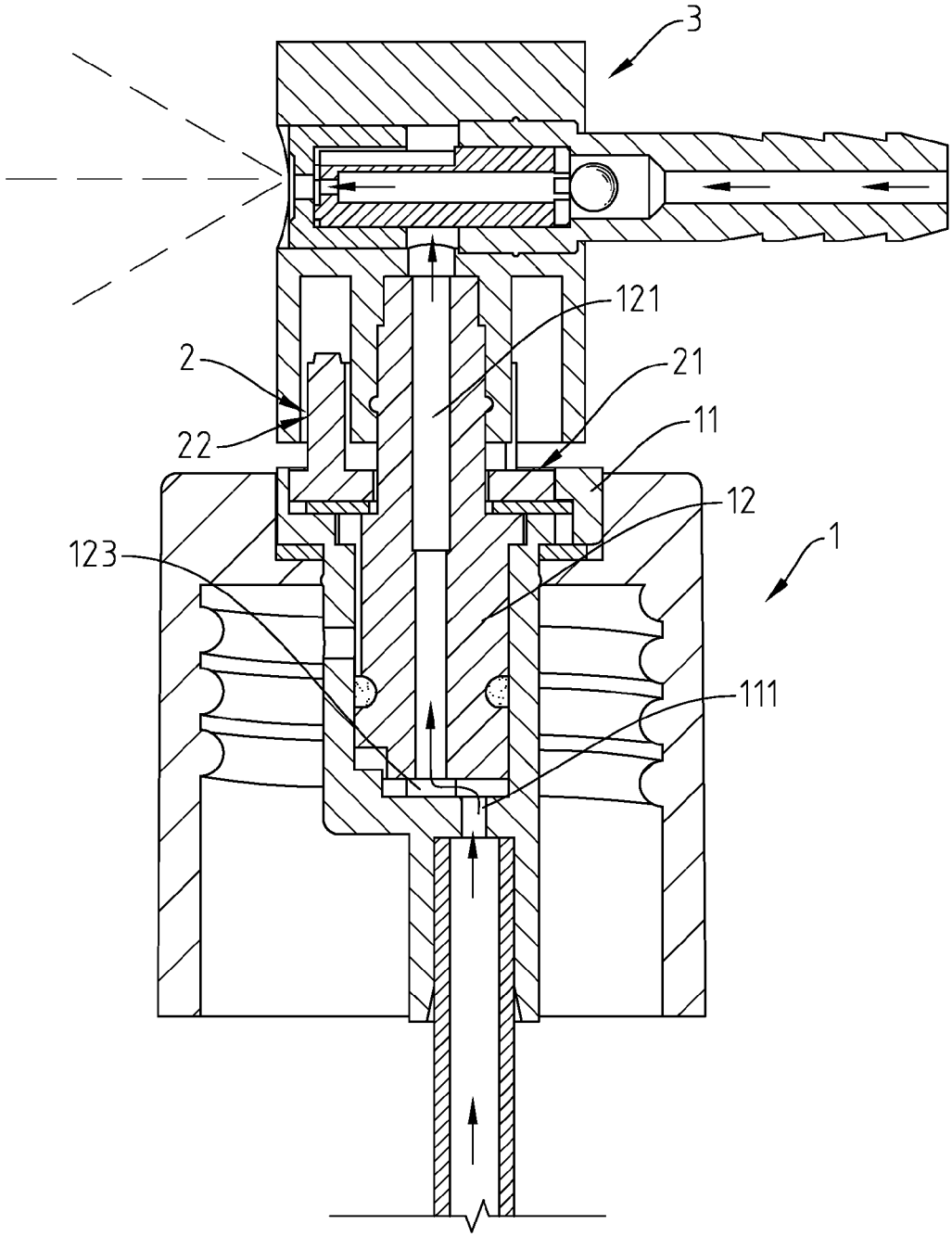
FIG. 8 is a sectional side view of the leak-proof perfume bottle spray head assembly with positioning sound indication in accordance with the present invention.
Figure 9:
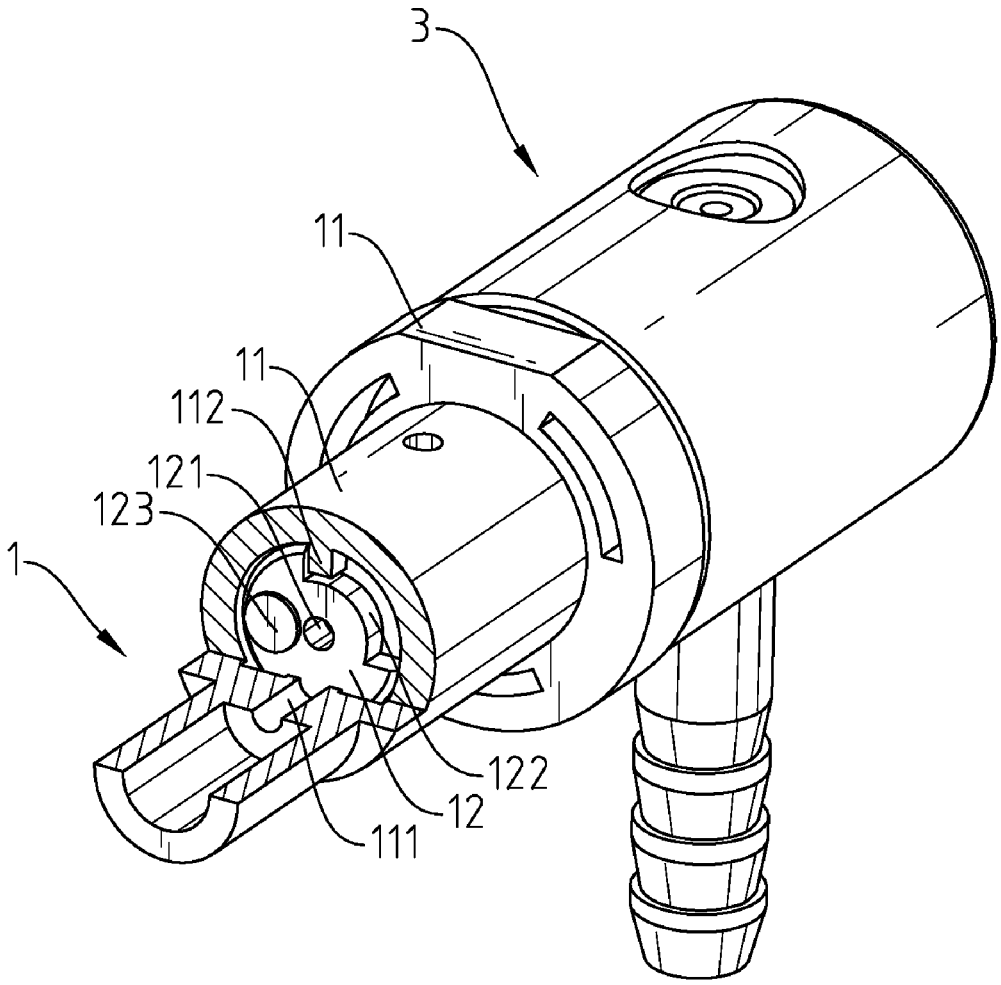
FIG. 9 is a cutaway view of the leak-proof perfume bottle spray head assembly with positioning sound indication in accordance with the present invention.
Figure 10:
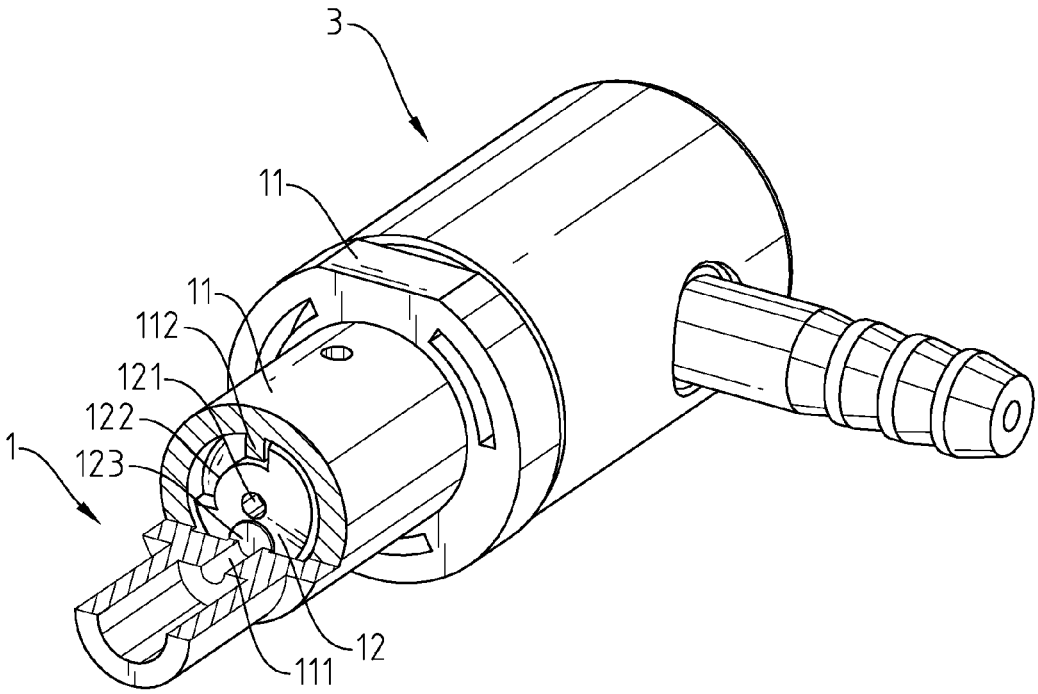
FIG. 10 corresponds to FIG. 9, illustrating the rotating shaft in the close position.
Figure 11:
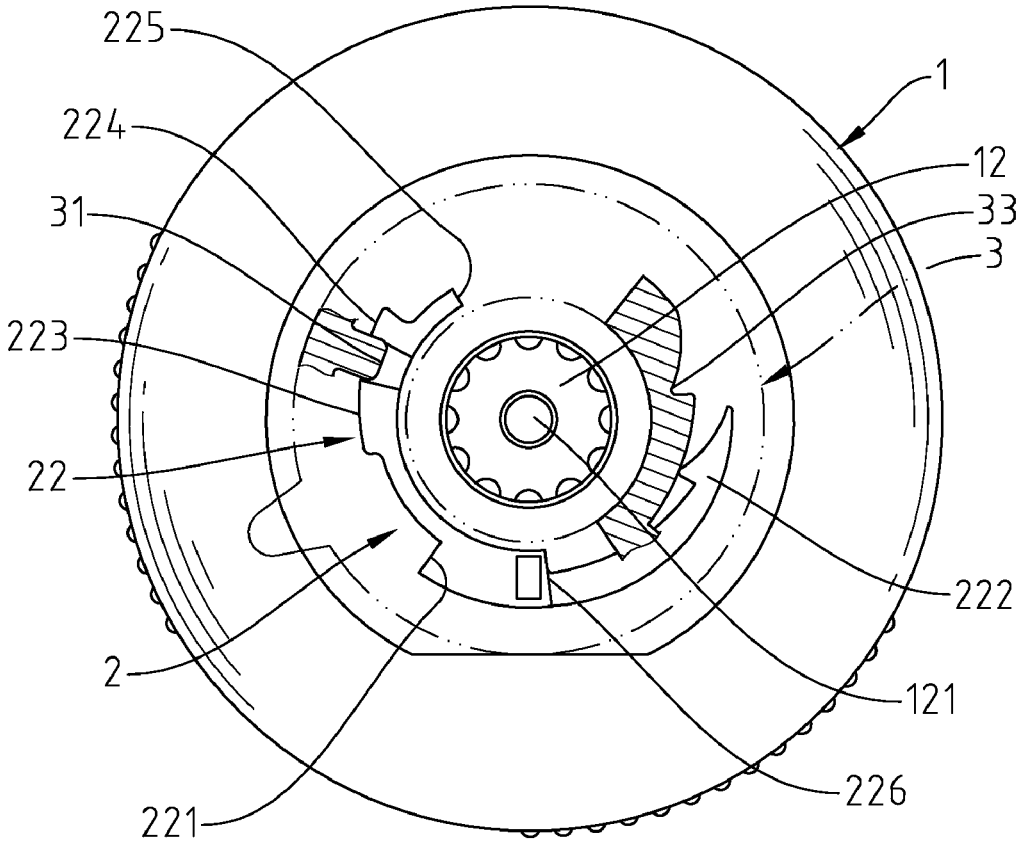
FIG. 11 is a schematic sectional top view of the present invention, illustrating rotation of the rotating shaft with the spray head from the open position to the close position (I).
Figure 12:
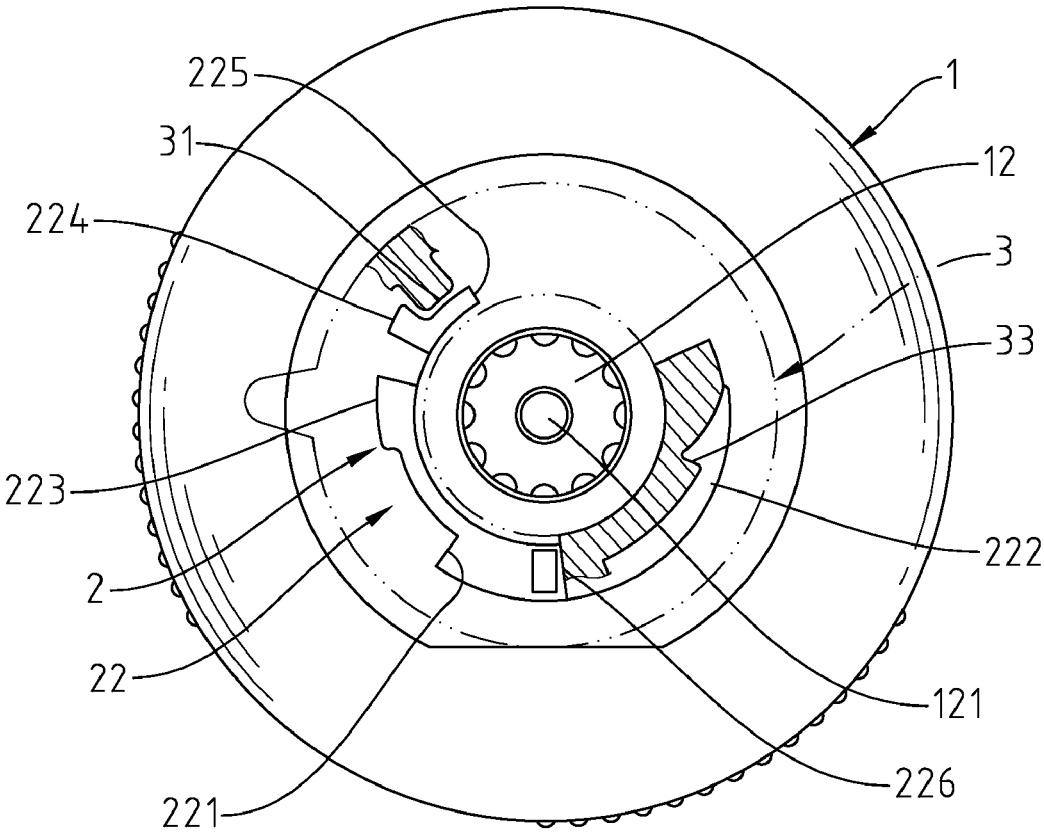
FIG. 12 is a schematic sectional top view of the present invention, illustrating rotation of the rotating shaft with the spray head from the open position to the close position (II).
Figure 13:
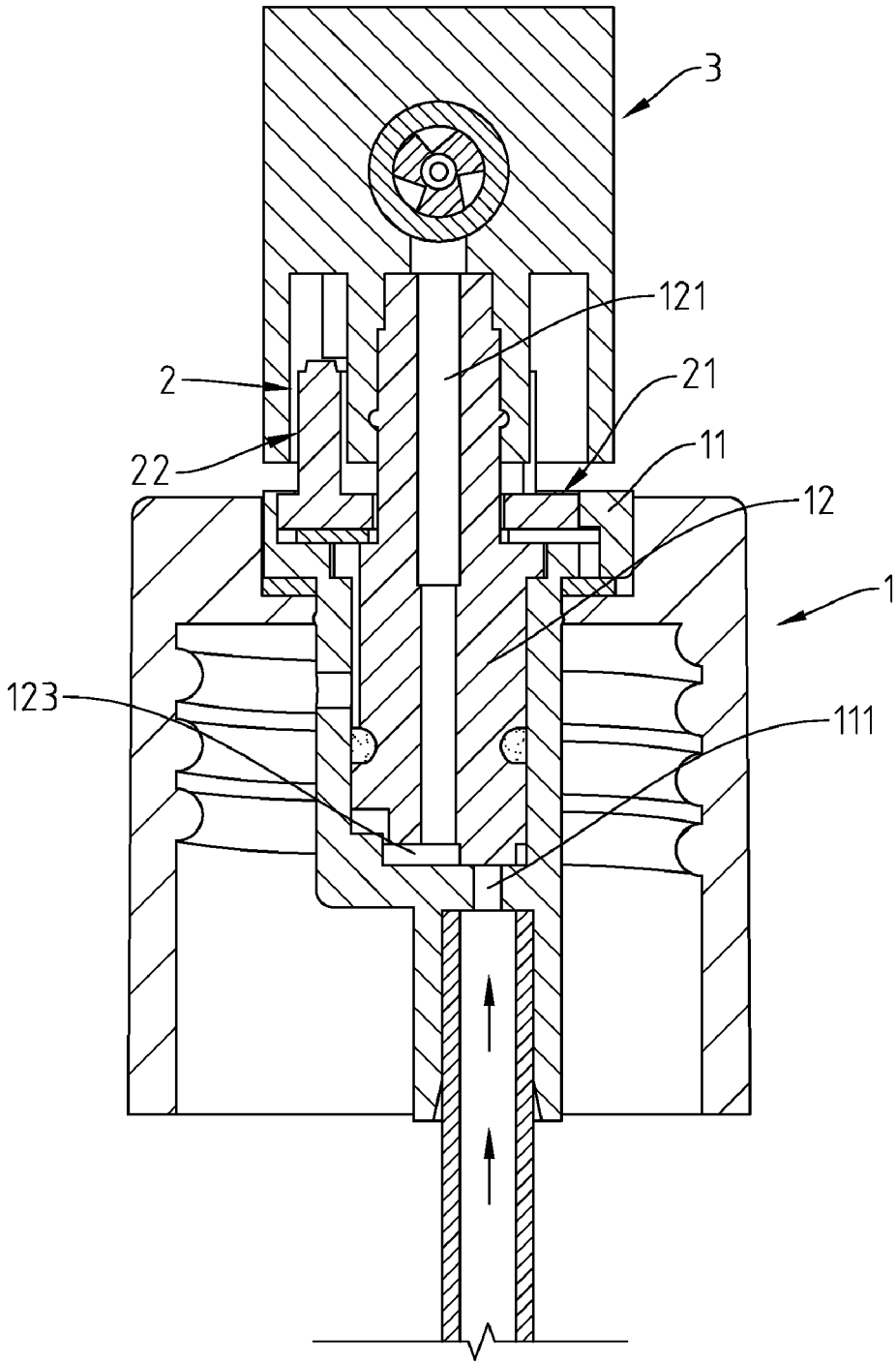
FIG. 13 is a sectional side view of the present invention, showing the leak-proof perfume bottle spray head assembly in the close position.

Referring to FIGS. 7-9, the user can operate the spray head 3 to rotate the rotating shaft 12 between an open position and a close position. When the user operates the spray head 3 to rotate the rotating shaft 12 to the open position for applying the perfume, the bottom bump 123 of the rotating shaft 12 is kept away from the bottom inlet 111 of the tubular holder block 11, allowing the perform to forced through the bottom inlet 111 of the tubular holder block 11 into the axial hole 121 of the rotating shaft 12 and then driven out of the spray head 3 for application.

Referring to FIGS. 10-43, when the user is operating the spray head 3 to rotate the rotating shaft 12 to the close position after an application, the deformable rail 31 of the spray head 3 is moved away from the positioning face 221 of the sound-making unit 22 of the positioning block 2 and the retaining portion 33 of the spray head 3 is moved toward the retaining rib 222 of the sound-making unit 22 of the positioning block 2. When the deformable rail 31 of the spray head 3 is moved over the first protruding portion 223 and the second protruding portion 224 to have the retaining portion 33 of the spray head 3 be stopped at the second stop face 226 and to force the retaining portion 33 of the spray head 3 into engagement with the retaining rib 222 of the sound-making unit 22 of the positioning block 2, the deformable rail 31 of the spray head 3 is elastically deformed to produce click sound twice. Subject to this sound indication, the user knows that the spray head 3 has been accurately shifted to the close position where the bottom bump 123 of the rotating shaft 12 is stopped at the bottom inlet 111 of the tubular holder block 11 to block the passage between the bottom inlet 111 of the tubular holder block 11 and the axial hole 121 of the rotating shaft 12, and therefore the perfume bottle has been well sealed against leakage. When rotating the spray head 3 in the reversed direction to disengage the retaining portion 33 of the spray head 3 from the retaining rib 222 of the sound-making unit 22 of the positioning block 2, the deformable rail 31 of the spray head 3 will be moved over the sound-making unit 22 of the positioning block 2 and stopped against the positioning face 221 of the sound-making unit 22 of the positioning block 2, thereby opening the perfume passage of the perfume bottle spray head assembly.

In conclusion, the invention provides a leak-proof perfume bottle spray head assembly with positioning sound indication, which has the following technical features and advantages:

1. The deformable rail 31 of the spray head 3 is elastically deformable. When rotating the spray head 3 to the close position to force the retaining portion 33 of the spray head 3 into engagement with the retaining rib 222 of the sound-making unit 22 of the positioning block 2, the deformable rail 31 will be moved over the first protruding portion 223 and the second protruding portion 224 to produce click sound twice. Subject to this sound indication, the user knows that the spray head 3 has been accurately shifted to the close position, avoiding over-tightened damage.

2. When the click sound is produced as the user closes the spray head 3, the retaining portion 33 of the spray head 3 is simultaneously forced into engagement with the retaining rib 222 of the sound-making unit 22 of the positioning block 2 to prevent falling of the spray head 3 from the bottle cap 1, and at the same time the retaining portion 33 is stopped against the second stop face 226 of the sound-making unit 22, prohibiting over-rotation of the spray head 3 and damage of the protruding rod 112 by the sliding groove 122.

What the invention claimed is:

1. A leak-proof perfume bottle spray head assembly, comprising:

a bottle cap having a tubular holder block and a rotating shaft rotatably mounted in said tubular holder block;

a positioning block, said positioning block comprising a base coupled to said rotating shaft and a sound-making unit extended from said base along the periphery thereof, said sound-making unit comprising a positioning face at one side thereof and a retaining rib at an opposite side thereof; and a spray head coupled to said rotating shaft and adapted for rotating said rotating shaft between a close position and an open position, said spray head comprising a deformable rail longitudinally located on an inside wall thereof at one side and adapted for rubbing against said sound-making unit to make click sound during rotation of said rotating shaft by said spray head from said open position to said close position, and a retaining portion located on the inside wall opposite to said deformable rail for engagement with said retaining rib when said rotating shaft reaches said close position.

2. The leak-proof perfume bottle spray head assembly as claimed in claim 1, wherein said tubular holder block has a top recess and a plurality of locating notches equiangularly spaced around said top recess for the positioning of said positioning block.

3. The leak-proof perfume bottle spray head assembly as claimed in claim 2, wherein said base of said positioning block comprises a plurality of ribs equiangularly spaced around the periphery thereof and respectively positioned in said locating notches of said tubular holder block, and a through hole coupled to said rotating shaft of said bottle cap.

4. The leak-proof perfume bottle spray head assembly as claimed in claim 1, wherein said spray head comprises an coupling tube axially suspending on the inside thereof and coupled to said rotating shaft; said retaining rib of said sound-making unit of said positioning block is disposed at one lateral side relative to said coupling tube.

* * * * *